US006026751A

United States Patent [19]

Tsai

[11] Patent Number: 6,026,751

[45] Date of Patent: Feb. 22, 2000

[54] COLLAPSIBLE TABLE

[76] Inventor: Ming-Liang Tsai, 4F-3, No. 8, Fu-Chin Street, Taipei, Taiwan

[21] Appl. No.: 09/223,802

[22] Filed: Dec. 31, 1998

[51] Int. Cl.[7] ..... A47B 3/00

[52] U.S. Cl. ..... 108/34; 108/115

[58] Field of Search ..... 100/115, 34, 35, 100/36, 67, 157.16, 99, 119, 157.18, 118

[56] References Cited

U.S. PATENT DOCUMENTS

| | | | |
|---|---|---|---|
| 455,681 | 7/1891 | Cummer | 108/35 |
| 653,762 | 7/1900 | Windom | 108/35 X |
| 1,295,194 | 2/1919 | Parelius | 108/34 |
| 1,564,189 | 12/1925 | Anderson | 108/35 |
| 2,023,870 | 12/1935 | Casott | 108/34 |
| 2,535,921 | 12/1950 | Hart | 108/34 X |
| 2,878,086 | 3/1959 | Voloshin | 108/35 |
| 3,074,770 | 1/1963 | Joos | 108/35 |
| 3,387,572 | 6/1968 | Ulrich | 108/34 |
| 4,341,164 | 7/1982 | Johnson | 108/115 X |
| 5,794,546 | 8/1998 | Carter | 108/115 |

*Primary Examiner*—Jose V. Chen
*Attorney, Agent, or Firm*—Rosenberg, Klein & Bilker

[57] ABSTRACT

A collapsible table structure includes a table top having a plurality of top leaves arranged side by side and pivoted to each other. A plurality of legs support the table top. Every two adjacent legs are connected to each other by mean of a pair of centrally pivoted bars, each having an end pivoted to one of the two adjacent legs and another pivoted to a collar that is slidable along the leg, thereby allowing the legs to be moved between a collapsed position and an opened position. One of the legs comprises a joint device provided on the top end thereof for forming a two direction pivotal joint with the table top and another one of the legs has a top retaining device mounted on the top end thereof for releasably retaining the table top thereon. The table top may be released from the legs and the top and legs may be separately collapsed. The collapsed legs may be enclosed in the collapsed table top, thereby minimizing the storage space that is needed for the collapsed table.

13 Claims, 5 Drawing Sheets

COLLAPSIBLE TABLE

FIELD OF THE INVENTION

The present invention generally relates to a table, and in particular to a collapsible table structure.

BACKGROUND OF THE INVENTION

Tables are commonly supported by three or four legs. The legs may be fixed to the table top. This takes a large space to store the table. Further, it is very inconvenient to move this type of fixed table.

To overcome such a problem, tables having drop leaves are developed, which allows the table top to be partially collapsible and thus saving some space in stowing and moving the table. Another collapsible design of the table provides the table with collapsible legs which are foldable toward the table top to be underlapped the table top. Both kinds of table are only partially collapsible. It still takes a large storage space and inconvenient in moving from one place to another.

It is thus desirable to have a fully collapsible table structure which overcomes the problems encountered in the prior art.

SUMMARY OF THE INVENTION

Accordingly, an object of the present invention is to provide a fully collapsible table structure which allows both the table top and the table legs to be collapsed for reducing storage space and being convenient for transportation.

To achieve the above objects, in accordance with the present invention, there is provided a collapsible table structure comprising a table top comprising a plurality of top leaves arranged side by side and pivoted to each other. A plurality of legs support the table top. Every two adjacent legs are connected to each other by means of a pair of centrally pivoted bars, each having an end pivoted to one of the two adjacent legs and another pivoted to a collar that is slidable along the leg, thereby allowing the legs to be moved between a collapsed position and an opened position. One of the legs comprises a joint device provided on the top end thereof for forming a two direction pivotal joint with the table top and another one of the legs has a top retaining device mounted on the top end thereof for releasably retaining the table top thereon. The table top may be released from the legs and the top and legs may be separately collapsed. The collapsed legs may be enclosed in the collapsed table top, thereby minimizing the storage space that is needed for the collapsed table.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 2:
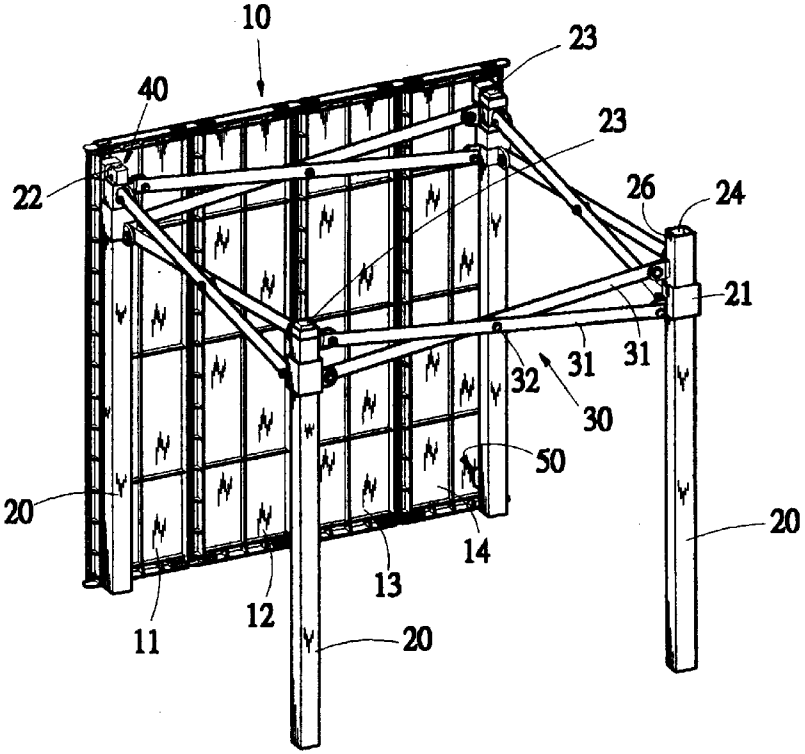
FIGS. 2–4 shows the process of collapsing the table of the present invention from the expanded condition to a collapsed condition.
Figure 1:
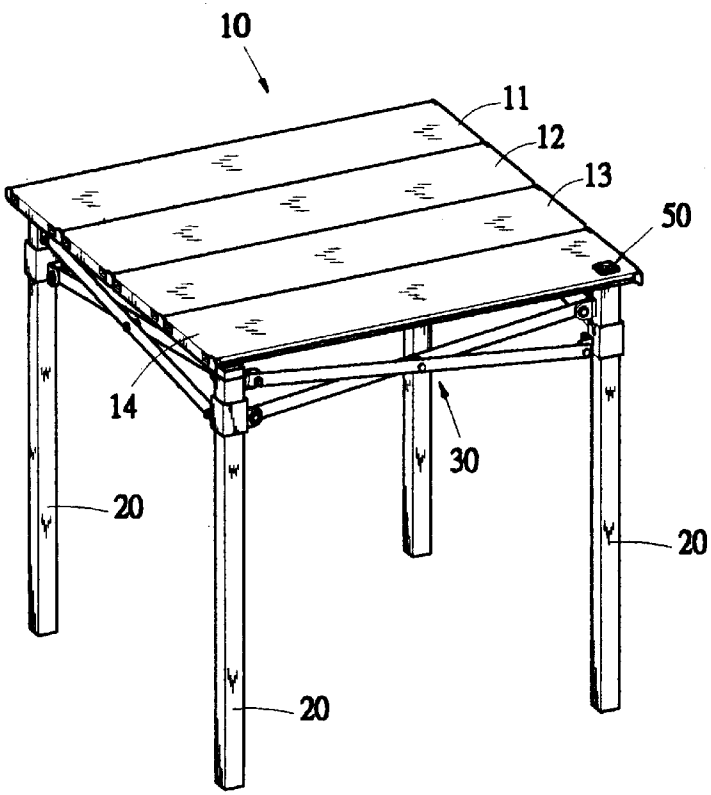
FIG. 1 is a perspective view showing a collapsible table constructed in accordance with the present invention in an expanded condition.

With reference to the drawings and in particular to FIGS. 1 and 2, wherein a collapsible table constructed in accordance with the present invention is shown, the table comprises a table top 10 positionable on and thus supported by a number of table legs 20. Preferably and as illustrated, the table top 10 comprises a quadrilateral or rectangular configuration formed by a number of elongate table leaves 11, 12, 13 and 14 is supported by four legs 20. Preferably, the table top 10 is constituted by four leaves 11–14 having the same length and width, but if desired, there may be more or less leaves constituting the table top 10, for example three or six or eights leaves and the leaves 11–14 may be for different length and width. IF desired, the leaves 11–14 may be made in such a way that they together forms for example a circular or polygonal table top.

As shown in FIGS. 1 and 2, the four legs 20 are located at four corners of the quadrilateral table top 10. Each leg 20 has a top end supporting the table top 10 thereon. A first one of the four legs 20, which will be referred to as the top-jointing leg herein, comprises a two direction joint means 40 mounted to the top end thereof for pivotally connecting the table top 10 to the top-jointing leg 20. A second one of the legs 20 which is diagonally opposite the top-jointing leg 20 and will be referred to as top-securing leg herein, comprises top retaining means 50 arranged on the top end thereof for releasably retaining the table top 10 to the top-securing leg 20. The remaining two legs 20 which are diagonally opposite to each other comprise a top support member 23 fixed on the top ends thereof which are engageable with counterpart support members 17 provided on underside of the table top 10 for supporting the table top 10.

Every two adjacent legs 20 are connected by a connection device 30, which on the embodiment illustrated comprises a pair of stretch bars 31 which are pivoted to each other substantially at central sections thereof as indicated at 32. Each of the stretch bars 31 has a first end pivoted to a corresponding one of the two legs 20 proximate the upper end of the leg 20 and a second end pivoted to a slide collar 21 movably fit over another one of the two legs 20 whereby by moving slides 21 along the legs 20, the stretch bars 31 are forced to rotate about the central pivot 32 and thus moving the legs 20 from a spaced, expanded position (FIGS. 1 and 2) to a substantially overlapped, collapsed position (FIG. 3) an changing the distance between the two legs 20.

Figure 8:
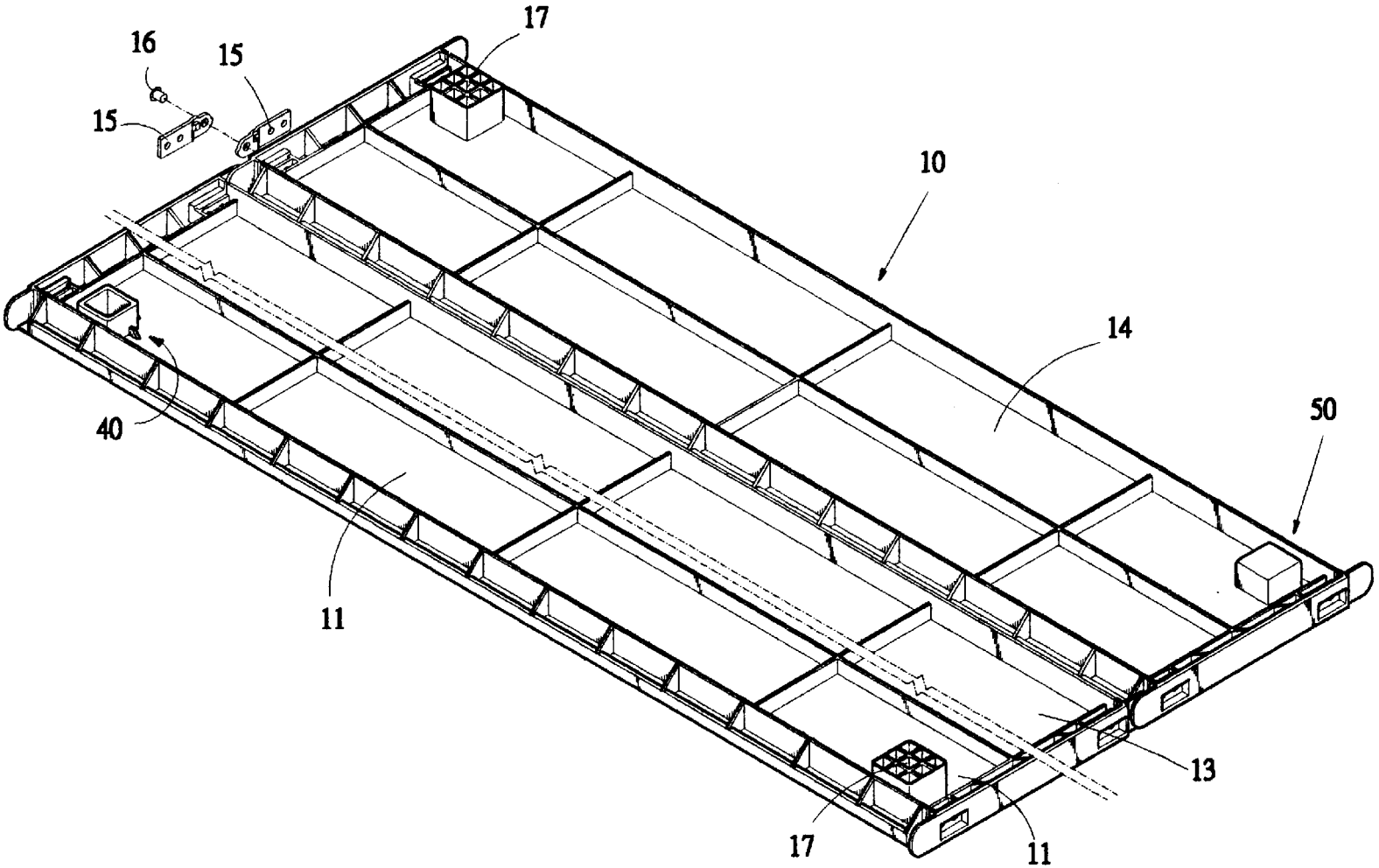
FIG. 8 is a perspective view showing the table top of the table in accordance with the present invention in an up-side down manner.

The four leaves 11–14 are arranged side by side and each leaf 11, 12, 13 or 14 is pivoted to the next leaf or leaves. As shown in FIG. 8, each of two adjacent leaves (such as the table leaves 13 and 14 as shown in FIG. 8) comprises a pivotal joint member 15 fixed to at least one of two end edges thereof. Preferably, the two leaves 13 and 14 are pivoted to each other at both end edges.

Figure 4:
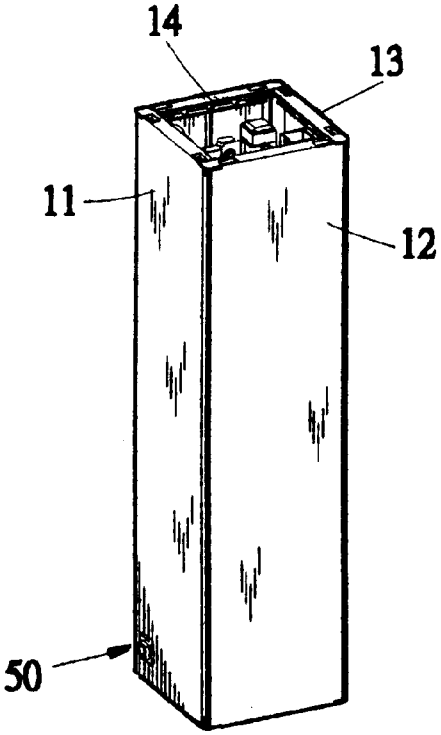

The pivotal joint members 15 of the two leaves 13 and 14 have an overlapped portions defining therein through holes through which a pivot pin 16 extends, thereby pivoting the two leaves 13 and 14 together. The pivotal joint between the leaves 11–14 allow the table top 10 to be collapsed from an expanded condition shown in FIG. 3 into a collapsed condition which defines a hollow "rectangular post" as shown in FIG. 4 in which the collapsed legs 20 may be housed.

Figure 5:
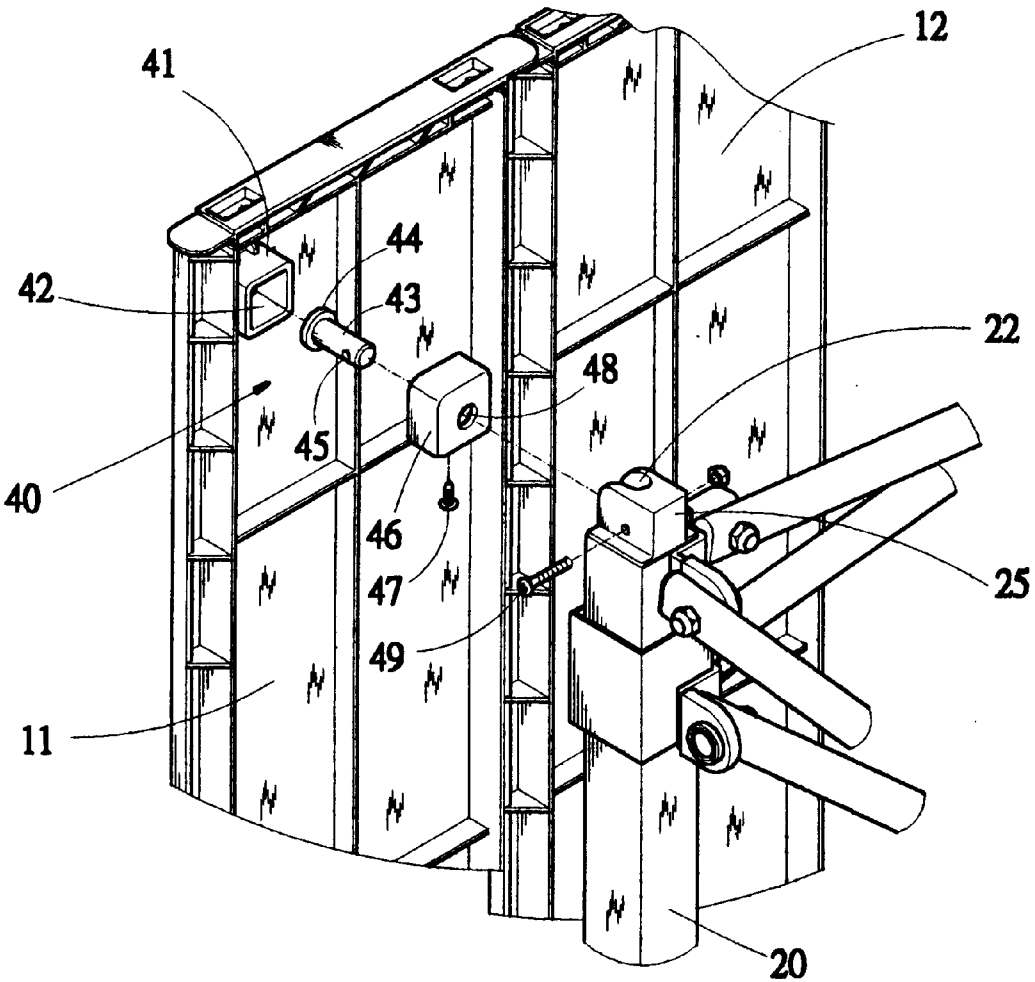
FIG. 5 is a perspective view of a portion of the table of the present invention showing a joint device arranged between the table top and one of the table legs.

Referring to FIG. 5, wherein the two direction joint means 40 in accordance with the present invention is shown, the joint means 40 which the table top 10 to rotate with respect to the legs 20 about two axes substantially normal to each other from the leg-supported condition shown in FIG. 1 to a juxtaposing-leg condition shown in FIG. 2, comprises a pin holder 41 fixed to the underside of the table top 10 at a location corresponding to the top-jointing leg 20. The holder 41 defines therein a receptacle chamber 42 in which an expanded end 44 of a primary pivotal pin 43 of the joint means 40 is rotatably received and confined by a cap member 46 fit over the holder 41. This allows the table top 10 to be rotatable with respect to the primary pivotal pin 43 about a central axis thereof. The primary pivotal pin 43 has a free end extending out of the receptacle chamber 42 through a hole or bore defined in the cap 46. A screw 47 secures the cap member 46 to the pin holder 41.

The free end of the primary pivotal pin 43 is movably received in a slot 22 defined by two spaced walls in a base member 25 and pivoted thereto by means of a secondary pin or bolt 49 extending through the spaced wall of the base member 25 and a transverse hold 45 of the primary pivotal pin 43, thereby defining a knuckle joint. Thus, the secondary pivotal pin 43, thereby defining a knuckle joint. Thus, the second pin 49 is substantially normal to the pivot pin 43 and allows the table top 10 to rotate about a central axis thereof which is substantially normal to the central axis of the primary pin 43. The base member 25 is fixed to the top end of the top-jointing leg 20. The spaced side walls of the base member 25 defines an are configuration which is concentric with the secondary pivot 49, thereby allowing the primary pivotal pin 43 to rotate about the secondary pivot 49 with the cap 46 moving along the arc of the base member 25. The primary pivotal pin 43 and the bolt 49 respectively define the two rotational axis of the table top 10 with respect to the top-jointing leg 20.

Figure 7:
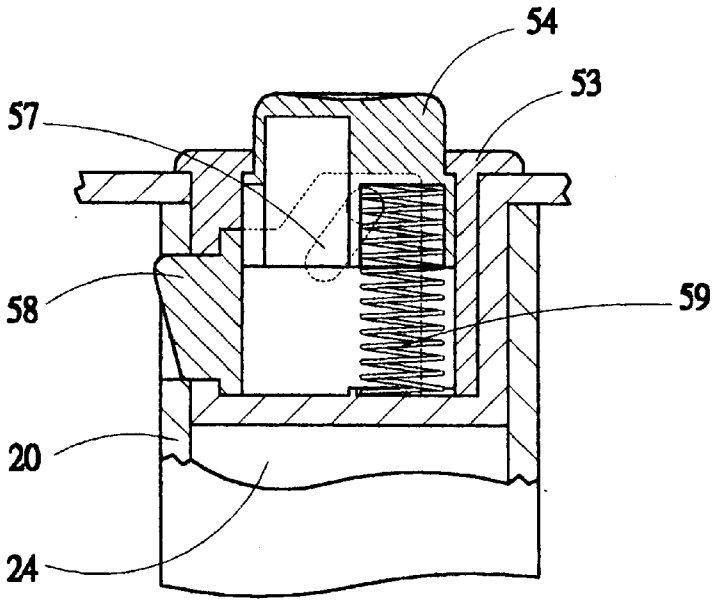
FIG. 7 is a cross-sectional view of the top retaining device retaining the table top on the leg.
Figure 6:
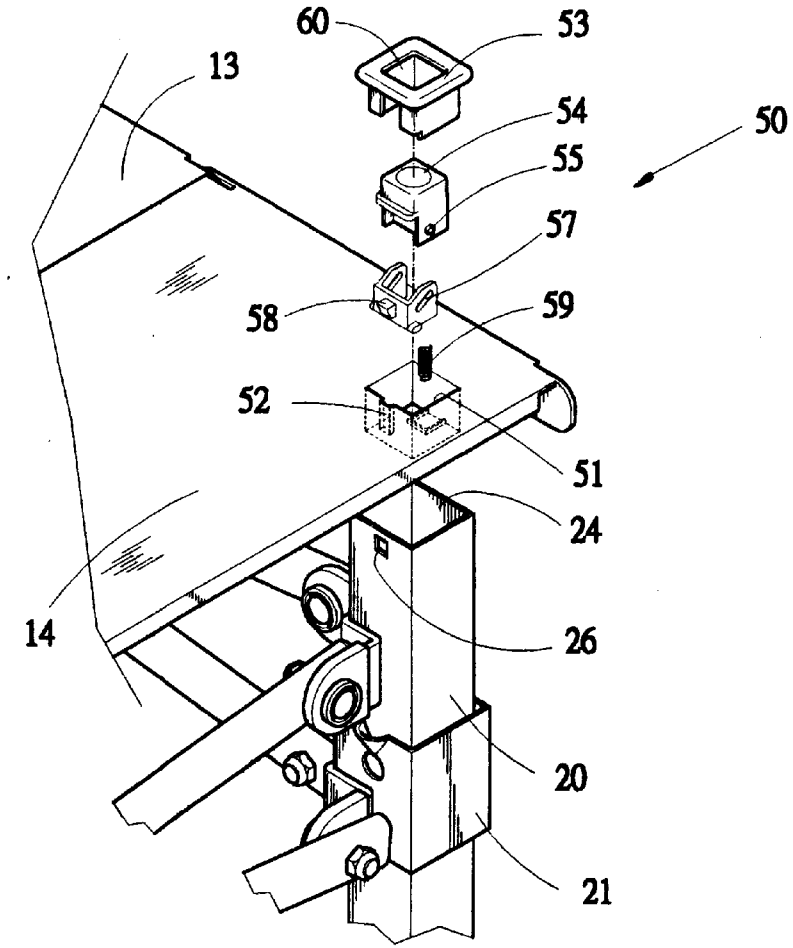
FIG. 6 is a perspective view of a portion of the table of the present invention showing a top retaining device for retaining the table top to one of the table legs.

Referring to FIGS. 1, 6 and 7, the top retaining device 50 comprises an opening 51 defined in the table leaf 14 in which an actuator holder 53 in the form of a tubular member is received and fixed. The holder 53 defines a central bore 60 in which an actuator or push button 54 is received and axially movable between a released position and an actuated position. The holder 53 is receivable into an end bore 24 formed in top end of the top-securing leg 20 defined by side walls of the leg 20. An opening 26 is formed in one of the side walls and in communication with the end bore 24.

The push button 54 comprises two pins 55 extending therefrom in opposite directions. A U-shaped member 56 having two side panels each having an inclined slot 57 defined therein for movably receiving the corresponding pin 55 of the push button 54. A spring 59 is disposed between the push button 54 and the holder 53 to bias the push button 54 to the actuated position.

The U-shaped member 56 has a bottom section on which an outward protruding barb 58 is formed, which is guided in a groove 52 defined in the opening 51 to move transversely with respect to the holder when the push button 54 is actuated to move axially along the holder 53 whereby the barb 58 engages with the opening 26 of the top-securing leg 20 to secure the table top 10 to the table-securing leg 20.

Figure 3:
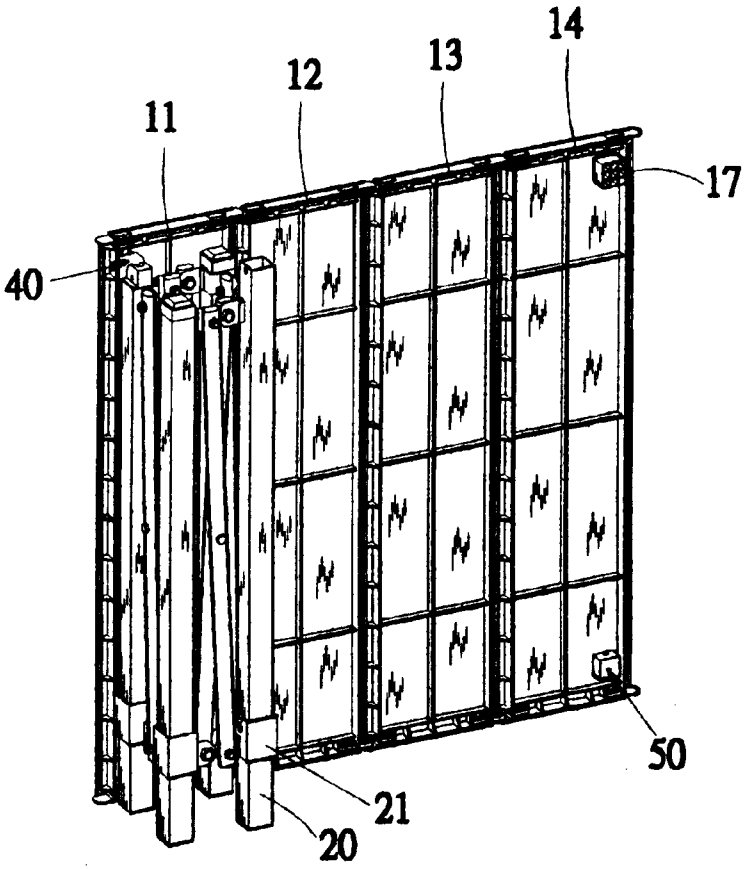

In moving the push button 54 against the spring 59 from the actuated position to the release position, the inclined slots 57 forces the barb 58 to disengage from the opening 26 of the top-securing leg 20, thereby releasing the table top 10 from the top-securing leg 20. This allows the table top 10 to be moved with respect to the legs 20 from the leg-supported condition of FIG. 1 to the juxtaposing leg-condition of Figure by rotating the table top 10 with respect to the top-jointing leg 20 about the rotational axes defined by the primary and secondary pivots 43 and 49 of the joint means 40. The legs 20 and table top 10 are then separately collapsed as shown in FIGS. 3 and 4 to enclose the collapsed legs 20 in the interior space defined by the collapsed leaves 11–14.

Although the present invention has been described with reference to the preferred embodiment thereof, it is apparent to those skilled in the art that a variety of modifications and changes may be made without departing from the scope of the present invention, such as replacing the pivot pin between the table leaves with a hinge, which is intended to be defined by the appended claims.

What is claimed is:

1. A collapsible table comprising:

a table top comprising a plurality of table top leaves arranged side by side, each leaf being pivotally coupled to an adjacent one of the leaves for displacement thereof from an expanded position to a collapsed position;

a plurality of legs spaced from each other, each having a top end supporting the table top thereon, connection means being arranged between two adjacent ones of the legs which allows the two legs to move from a spaced, expanded position to a substantially overlapped, collapsed position;

two-direction joint means fixed to an underside of the table top and the top end of a first one of the plurality of legs, said two-direction joint means including a primary pin having a first end rotatably received and retained in a receptacle defined in the table top which allows the table top to be rotatable about a central axis thereof, the primary pin having a second end pivoted to the top end of the first leg by means of a secondary pin having a central axis normal to the central axis of the primary pin which allows the table top to rotate about the central axis of the secondary pin, where the table top is displaceable from an expanded condition supported by the legs to a condition where the table top juxtaposing the legs with the leaves parallel to the legs; and, retaining means mounted to the table top for releasably securing the table top to the top end of a second one of the plurality of legs whereby the retaining means and the two-direction joint means together releasably secure the table top on the top ends of the legs;

wherein by releasing the retaining means to separate the table top form the second leg and rotating the table top about the primary pin and the secondary pin of the two-direction joint means to displace the table top from the leg-supported condition to the juxtaposing-leg condition, the legs are allowed to collapse from the expanded position to the collapsed position and the table top leaves are also allowed to collapse from the expanded position to the collapsed position.

2. The collapsible table as claimed in claim 1, wherein the table top leaves have opposite end edges and wherein each of the leaves comprises a member fixed to at least one of the end edges, the member having a hold defined therein, the hole of the member of the leaf overlapping the hole of the member of a next one of the leaves, a pivot pin extending through both holes for pivoting the leaves together.

3. The collapsible table as claimed in claim 1, wherein the connection means between the two adjacent legs comprises two bars having first ends respectively pivoted to the two legs and second ends pivoted to collars which are respectively slidable along the legs, the bars being pivoted to each other at a center section thereof.

4. The collapsible table as claimed in claim 1, wherein the top end of the first leg has a slot defined by two side walls having an arc configuration in which the second end of the primary pin is received, the secondary pin extending through the side walls and the primary pin to define a knuckle joint.

5. The collapsible table as claimed in claim 4, wherein a cap is fit over the receptacle of table top to retain the first end of the primary pin therein, the cap having a bore through which the second end of the primary pin extends, the cap being slidable along the arc configuration of the side walls of the top end of the first leg.

6. The collapsible table as claimed in claim 1, wherein the retaining means comprises a channel defined in the table top and receivable in an end bore defined by side walls of the top end of the second leg, a push button being received in the channel and axially movable therein between a secured position and a released position, the push button being spring-biased to the secured position, an engaging member coupled to and controlled by the push button to move from a first position wherein a barb of the engaging member engages an opening defined in one of the side walls of the top end of the second leg thereby securing the table top to the second leg and a second position wherein the barb disengages from the opening of the side walls of the top end of the second leg thereby releasing the table top from the second leg.

7. The collapsible table as claimed in claim 6, wherein the channel comprises a tubular member fit into an opening defined in the table top, the tubular member having a lower end receivable into the end bore of the second leg.

8. The collapsible table as claimed in claim 7, wherein the engaging member comprises a U-shaped body having two sides fit over the push button and a bottom section on which the barb is formed, the push button comprising a pin movably received in an inclined slot defined in each of the sides of the U-shaped engaging member, whereby axially moving the push button along the channel allows the barb to move transversely with respect to the channel and thus engageable with the opening of the side walls of the top end of the second leg.

9. The collapsible table as claimed in claim 1, wherein the table top comprises four leaves arranged side by side and pivoted to each other.

10. The collapsible table as claimed in claim 9, wherein the four leaves have the same length, thereby forming a quadrilateral table top.

11. The collapsible table as claimed in claim 1, wherein the table comprises four legs arranged in a quadrilateral form wherein the first and second legs are diagonally opposite to each other.

12. The collapsible table as claimed in claim 1, wherein the leaves are pivoted to each other for rotating with respect to each other in such a way to enclose an interior space in the collapsed position in which the collapsed legs are housed.

13. The collapsible table as claimed in claim 1, wherein the table comprises at least a third leg having a first support member fixed on top end thereof and wherein the table top comprises a second support member fixed to the underside thereof for being supported on the first support member of the top end of the third leg.

* * * * *